United States Patent [19]

Wasserstrom et al.

[11] Patent Number: 4,684,039

[45] Date of Patent: Aug. 4, 1987

[54] BEVERAGE DISPENSER VALVE ASSEMBLY SYSTEM FOR USE WITH PULPY CITRUS CONCENTRATE

[75] Inventors: Henry Wasserstrom, Chicago; Richard T. Kennedy, Palos Heights, both of Ill.

[73] Assignee: The Coca-Cola Company, Atlanta, Ga.

[21] Appl. No.: 594,189

[22] Filed: Mar. 28, 1984

[51] Int. Cl.[4] ..... B67D 5/56

[52] U.S. Cl. ..... 222/129.1; 222/145; 222/399; 222/1; 239/432

[58] Field of Search ..... 222/145, 129.1, 129.2, 222/129.3, 129.4, 399, 394, 396, 397; 239/432; 251/25, 45

[56] References Cited

U.S. PATENT DOCUMENTS

| | | | |
|---|---|---|---|
| 477,824 | 6/1892 | Robinson | 239/525 |
| 2,440,365 | 2/1945 | Copping et al. . | |
| 3,178,119 | 4/1965 | Thorson | 251/25 |
| 3,245,651 | 1/1966 | Erickson . | |
| 3,289,948 | 12/1966 | Fuerst . | |
| 3,369,755 | 12/1967 | Roden et al. . | |
| 3,412,970 | 5/1969 | Robarge . | |
| 3,593,738 | 9/1969 | Baerfuss . | |
| 3,625,402 | 9/1969 | Kulis . | |
| 3,727,844 | 4/1971 | Bencic . | |
| 3,966,091 | 4/1975 | Bencic . | |
| 4,026,316 | 3/1974 | Schots . | |
| 4,128,190 | 5/1977 | Gruber . | |
| 4,135,698 | 2/1977 | Thate et al. . | |
| 4,173,296 | 11/1979 | Marshall | 222/129.1 |
| 4,266,726 | 4/1979 | Brown et al. . | |
| 4,267,947 | 7/1979 | Wasserstrom . | |
| 4,270,673 | 7/1978 | Rodth . | |

OTHER PUBLICATIONS

Instrument Engineers Handbook–vol. I–Process Measurement, Bela G. Liptak, Editor; Chilton Book Company, New York, Philadelphia, London.

*Primary Examiner*—H. Grant Skaggs

[57] ABSTRACT

A beverage dispenser valve assembly for dispensing a beverage mixed from a pressurized citrus concentrate containing pulp and a diluent. The valve assembly includes a body having a concentrate passageway with a valving chamber having a flexible diaphragm therein for controlling concentrate flow therethrough. The diaphragm sealingly separates the concentrate valving chamber into an air pressure region and a concentrate region. A compressed air line is connected to the fluid pressure region through a solenoid controlled three-way, valve which valve can maintain pressure on the diaphragm to hold it closed or alternatively vent the pressure to atmosphere, allowing the diaphragm to open under the pressure of the concentrate.

4 Claims, 4 Drawing Figures

BEVERAGE DISPENSER VALVE ASSEMBLY SYSTEM FOR USE WITH PULPY CITRUS CONCENTRATE

BACKGROUND OF THE INVENTION

1. Field of the Invention

This invention relates to a valve assembly for a beverage dispenser in which a concentrate is mixed with a diluent, and more specifically to such a beverage dispenser valve assembly for use with a concentrate containing pulp.

2. Description of the Prior Art

Beverage dispenser valve assemblies are well-known for dispensing, for example, a mixture of syrup and carbonated water, and a mixture of fruit juice and water. Such beverage dispenser valve assemblies include a separate valving chamber for controlling the flow of the diluent from a pressure source, and a separate valving chamber for controlling the flow of the concentrate from either a gravity supply tank or from a pressurized tank. Such beverage dispenser valve assemblies are found in the well-known soda fountain beverage dispensers employed for the automatic post-mixing and dispensing of carbonated beverages. However, when it is desired to use a citrus concentrate that contains pulp, problems arise as a result of the existence of the pulp in the concentrate. The pulp tends to accumulate and block the orifices and it also interferes with the operation of the springs in the concentrate valving chamber. U.S. Pat. Nos. 4,270,673 and 4,267,947 show beverage dispensing valve assemblies for use with a concentrate containing pulp.

It is an object of the present invention to provide a beverage dispenser valve assembly system for use with pulpy citrus concentrate, which valve assembly overcomes the problems in the prior art valve assemblies.

It is another object of the present invention to provide a beverage dispenser valve assembly system in which the concentrate valve is operated solely by fluid pressure, without the use or assistance of a solenoid.

It is another object of the present invention to provide a valve assembly nozzle which reduces or prevents the spiralling of the fluid as it is dispensed.

SUMMARY OF THE INVENTION

A beverage dispenser valve assembly system for use with a pulpy citrus concentrate and a diluent, wherein the valve assembly includes a body having a concentrate valving chamber, a diluent valving chamber, a mixing chamber and a nozzle for dispensing the mixed beverage. A conventional solenoid operated diluent valve controls the flow through the diluent valving chamber, however, the flow through the concentrate valving chamber is controlled solely by fluid pressure on a diaphragm in the concentrate valving chamber. The diaphragm sealingly separates the concentrate valving chamber into a concentrate region below the diaphragm and a fluid pressure region above the diaphragm. A source of fluid (preferably air) under pressure is connected to the fluid pressure region through a three-way valve which is operated by a solenoid simultaneously with the operation of the solenoid that controls the diluent valve. Fluid pressure is maintained above the diaphragm to hold the concentrate valve closed when the valve assembly is not being used to dispense a beverage. When it is desired to operate the valve assembly to dispense a mixture of the concentrate and the diluent, the actuating handle of the valve assembly is operated which energizes a microswitch to simultaneously energize both solenoids. When the three-way valve solenoid is energized, it vents the fluid in the fluid pressure region to atmosphere, whereby the concentrate valve opens under the pressure exerted on the diaphragm by the concentrate in the concentrate region.

The nozzle of the valve assembly includes a flat transverse surface against which at least a portion of the fluid impinges and splashes back into oncoming fluid to provide good mixing, and also includes a flat longitudinal plate centrally positioned in the discharge passageway to reduce spiralling of the discharged beverage to reduce any splashing when the fluid with its pulp enters the cup.

BRIEF DESCRIPTION OF THE DRAWINGS

The present invention will be more fully understood from the following detailed description when read in connection with the accompanying drawings wherein like reference numerals refer to like elements and wherein.

DETAILED DESCRIPTION OF THE PREFERRED EMBODIMENT

Figure 1:
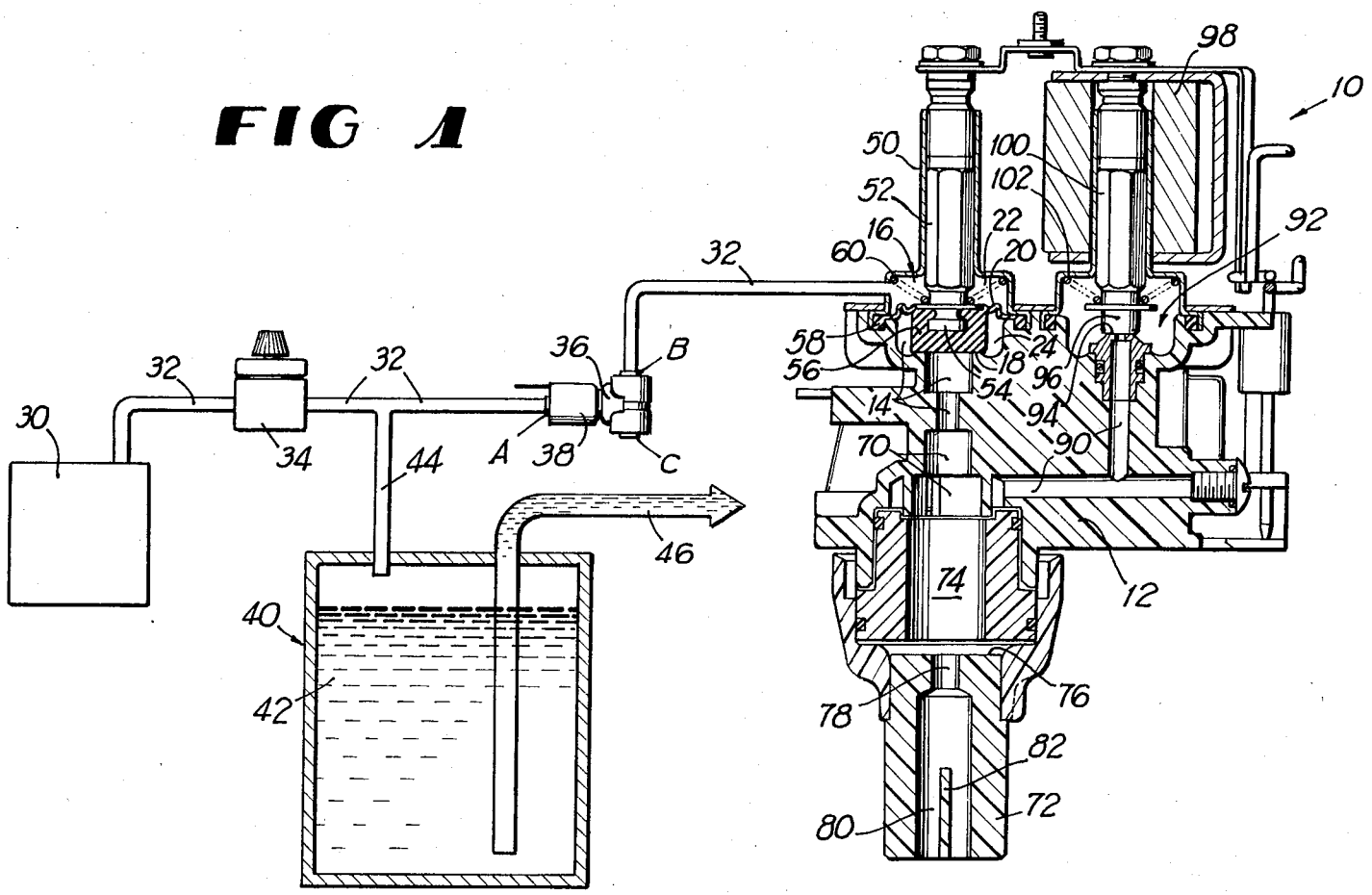
FIG. 1 is a cross-sectional side view through the beverage dispenser valve assembly of the present invention taken along line 1—1 of FIG. 2.

With reference now to the drawings, FIG. 1 shows a valve assembly 10 for a beverage dispenser, according to the present invention, which valve assembly 10 is a modification of the valve assembly shown in U.S. Pat. No. 4,266,726. The valve assembly 10 includes a body 12 having a concentrate passageway 14 extending therethrough, a concentrate valving chamber 16 in said body in fluid communication with said concentrate passageway 14, a valve seat 18 in said valving chamber 16 through which valve seat all fluid in said passageway 14 must flow, a flexible diaphragm 20 extending across said chamber 16 and sealingly separating said chamber 16 into a fluid pressure region 22 and a concentrate region 24. The opening defined by the valve seat 18 preferably has a diameter of 5/16 inch. The diaphragm 20 is movable, under fluid pressure exerted thereon, from a closed position (as shown in FIG. 1) in which it is in contact with said valve seat 18 and closes said passageway 14, to an open position (not shown) in which it is spaced apart from said valve seat and opens said passageway. The valve assembly 10 also includes means for maintaining the diaphragm 20 in its closed position when the valve assembly is not being operated to dispense a beverage and means for moving the diaphragm 20 to its open position when it is desired to operate the valve assembly to dispense a beverage therefrom.

The means for maintaining the diaphragm in its closed position and the means for moving the diaphragm to its open position will now be described also with reference to FIG. 1. The valve assembly system of the present invention as shown in FIG. 1 includes a pressurized air tank 30, an air line 32 (preferably 3/16 inch tubing) connected from the air tank 30 to the fluid pressure region 22, an air pressure regulator 34 located in the air line 32 and a three-way valve 36 located in the air line 32 between the regulator 34 and the fluid pressure region 22. The air pressure regulator 34 is preferably adjusted to provide an air pressure in the range of from about 25–35 psig. The air pressure is adjusted at each installation and the actual air pressure used depends on several factors such as the length of the air line 32 from the air tank 30. After a particular installation is made, a drink is dispensed and checked for correct ratio of diluent to concentrate and also for the desired flow rate, and then the air pressure regulator 34 is adjusted as necessary, and this process is repeated until the desired ratio and flow rate are achieved, as will be understood by one skilled in this art.

The three-way valve 36 includes three ports A, B and C. Port A is connected to the air line 32 coming from the pressure regulator 34 and port B is connected to the air line 32 going to the fluid pressure region 22. Port C is open to atmosphere. The three-way valve is solenoid operated by means of a solenoid 38. The three-way valve 36 has a first condition in which it establishes fluid communication between ports A and B and closes port C and has a second condition closing port A and establishing fluid communication between ports B and C. The three-way valve 36 is in its first condition when the solenoid 38 is unenergized. When the solenoid 38 is energized, it moves the three-way valve from its first condition to its second condition closing the line to the air tank 30 and venting the air from the fluid pressure region 22 to atmosphere.

The valve assembly system of the present invention also includes a refrigerated pressurizable container 40 for holding a quantity of concentrate 42. The container 40 is connected to the air line 32 by a pressurizing air line 44 which is connected to the air line 32 between the pressure regulator of 34 and the three-way valve 36. Thus, the pressure in the container 40 is at the same pressure as the air in the fluid pressure region 22. A conduit 46 is provided for feeding concentrate from the container 40 to the concentrate passageway 14 in any manner well-known in this art.

The body 10 includes an armature housing 50 having an elongated armature 52 mounted therein for vertical sliding or reciprocating movement. The armature 52 includes a lower end 54 connected to a valve member portion 56 of the diaphragm 20. The armature 52 aids in guiding the valve member portion 56 of the diaphragm 20 toward and away from the valve seat 18 as the diaphragm moves between its closed and open positions, respectively.

Figure 3:
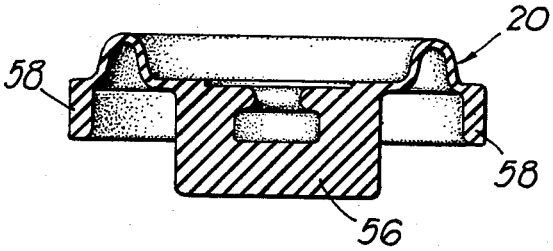
FIG. 3 is a cross-sectional view of the diaphragm of the present invention in its as-molded shape.

FIG. 3 is a cross-sectional view through the diaphragm 20 showing the valve member portion 56 which is thicker and stiffer than the remainder of the flexible diaphragm 20. The diaphragm 20 also includes a peripheral edge 58 that is sealingly clamped in a stationary position in said body 10, in particular between the armature housing 50 and the main body portion of the body 10. The lower end 54 of the armature 52 has an enlarged disk adapted to fit in the enlarged recess in the valve member portion of the diaphragm as shown in FIG. 3.

The diaphragm 20 thus sealingly separates the concentrate valving chamber 16 into the fluid pressure region 22 which is above the diaphragm and tree of concentrate, and the concentrate region 24 which is below the diaphragm. Because the air pressure in the fluid pressure region 22 above the diaphragm 20 operates against the diaphragm over a larger area than the does the concentrate in the concentrate region 24 below the diaphragm, the force exerted by the air pressure in the fluid pressure region 22 on the diaphragm is sufficient to maintain the diaphragm closed when the three-way valve is in its first condition. It is the difference in area between the upper and lower sides of the diaphragm that allows the air pressure in the fluid pressure region 22 to close the valve member portion 56. However, when it is desired to dispense a beverage from the valve assembly 10, the solenoid 38 is energized to move the three-way valve to its second condition which closes the air line 32 to the air tank 30 and vents the air in the fluid pressure region 22 to atmosphere. At this time, the force exerted on the diaphragm 20 from the concentrate in the concentrate region 24 is substantially greater than the force exerted by atmospheric pressure in the fluid pressure region 22 above the diaphragm 20, whereby the diaphragm immediately moves to its open position allowing concentrate to flow through the concentrate passageway 14 and past the valve seat 18. A compression spring 60 is preferably positioned in the fluid pressure region 22 to assist in biasing the diaphragm 20 to its closed position. It is preferred to have the three-way valve 36 located as close as possible to the valve assembly 10 and in the present invention the air line 32 from the three-way valve 36 to the fluid pressure region 22 is preferably eight to ten inches in length. In this way the diaphragm 20 opens substantially simultaneously with the energization of the solenoid 38.

Figure 4:
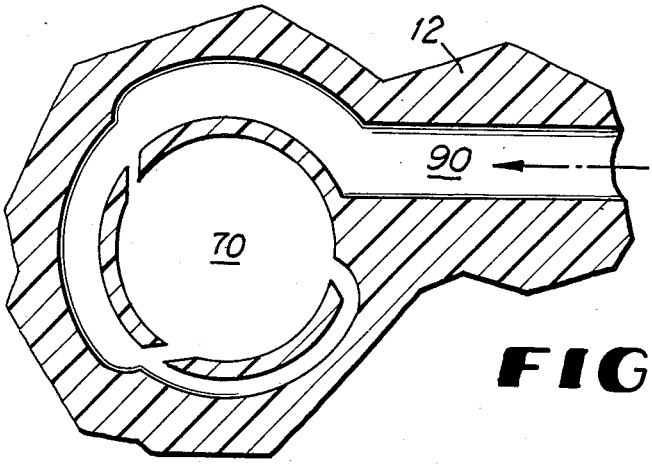
FIG. 4 is a cross-sectional view through the mixing chamber of the valve assembly of the present invention taken along line 4—4 of FIG. 1.

The valve assembly 10 also includes a mixing chamber 70 and a nozzle 72. The mixing chamber 70 is shown in cross-sectional view in FIG. 4 and is similar to that shown in U.S. Pat. No. 4,266,726 in FIG. 4 thereof. The concentrate and the diluent mix are caused to swirl together in the mixing chamber 70 as the mixture flows through the larger diameter passageway 74 toward a flat transverse surface 76 having a centrally positioned smaller diameter passageway 78 therein. At least some of the mixture flowing through the passageway 74 hits the surface 76 and splashes back into the passageway 74 promoting mixing. The nozzle 72 includes an elongated straight cylindrical passageway 80 having a flat elongated plate 32 centrally positioned therein to reduce the swirling of the mixture to reduce and preferably prevent any splashing of the beverage in a beverage cup positioned below the nozzle, which splashing could otherwise be caused by the pulp entering the cup.

The valve assembly 10 also includes a diluent passageway 90 extending therethrough, a diluent valving chamber 92 in the body 12 in fluid communication with the diluent passageway 90, a diluent valve seat 94 in the diluent valving chamber 92 through which valve seat 94 all diluent in said diluent passageway must flow, a diluent valve member 96 and a diluent valve member solenoid 98 for opening and closing the valve member 96. The solenoid 98 includes an armature 100 connected to the valve member 96. A compression spring 102 is located in the diluent valving chamber 92 for biasing the diluent valve member 96 into its closed position shown in FIG. 1. The diluent passageway 90 and the solenoid for controlling the flow through the diluent passageway are identical to that in the prior art as disclosed, for example, in U.S. Pat. No. 4,266,726.

Figure 2:
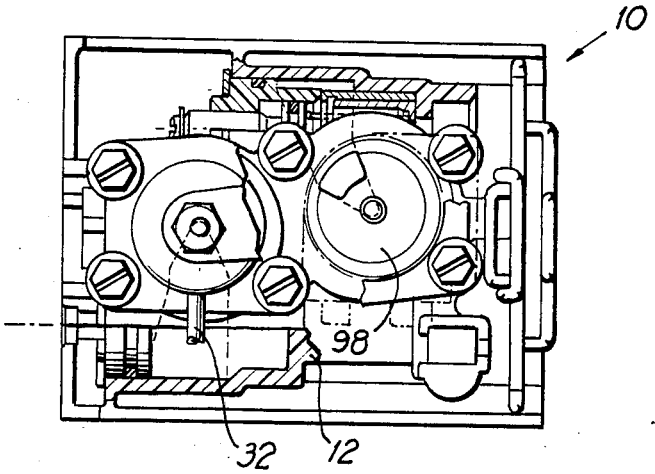
FIG. 2 is a top plan view of the valve assembly of FIG. 1 partly broken away and partly in cross-section.

FIG. 2 is a top plan view of the valve assembly 10 of the present invention. The valve assembly 10 includes a well-known flow control 100 for the diluent, identical to the carbonated water flow control 65 shown in U.S. Pat. No. 4,266,726. However, the valve assembly 10 uses no separate flow control device for the concentrate. That is, the concentrate flow control 51 shown in U.S. Pat. No. 4,266,726 is omitted and the opening to the flow control passageway is simply blocked. The flow of the concentrate is controlled in the present invention by the concentrate orifice size and by the air pressure in the concentrate container 40.

The flow through the valve assembly 10 is preferably about three ounces per second, however, the air pressure and the mechanical water flow control can be adjusted to reduce the dispensing rate to about 1½ ounces per second.

It will thus been seen that the present invention provides a method and apparatus for dispensing a beverage mixed from a concentrate containing pulp and a diluent which does not require the use of a solenoid to operate the concentrate valve in the concentrate valving chamber, but rather wherein the concentrate valve is a flexible diaphragm which is operated solely by fluid pressure thereon as controlled by a three-way valve located very close to the fluid pressure region and preferably operated simultaneously with the solenoid that operates the diluent valve.

It should thus be apparent that various alterations, modifications, and changes be made in the preferred embodiment illustrated herein without departing from the spirit and scope of the present invention as defined in the appended claims. For example, while one specific diaphragm is shown, other types and shapes and materials can be used. A spring 60 is shown in the fluid pressure region, however, it can be omitted, if desired. While it is preferred to have guide means for the diaphragm, this is not essential. Further, while the guide means shown comprise an armature and an armature tube, clearly other types and shapes of guide means can be used. One particular three-way valve has been shown, however, other valve means can be used to control the air pressure in the chamber 22, including, for example, two separate on-off valves. While solenoids are shown to operate the three-way valve and the diluent valve, other devices can be used. A particular mixing chamber and a particular nozzle have been shown, however, other chambers and nozzles can be used. For example, if no swirling is caused in the mixing chamber, then the plate 82 can be omitted. While the same pressure is used in the chamber 22 as in the container 40, different pressures can be used and two pressure regulators can be used. While citrus concentrate with pulp is the preferred concentrate, others can be used.

What is claimed is:

1. A valve assembly for a beverage dispenser for dispensing a beverage mixed from a pressurized concentrate containing pulp and a pressurized diluent, comprising:

(a) a body including a concentrate passageway extending therethrough;

(b) a concentrate valving chamber in said body in fluid communication with said passageway;

(c) a valve seat in said valving chamber through which valve seat all fluid in said passageway must flow;

(d) a flexible diaphragm extending across said chamber and sealing separating said chamber into a fluid pressure region and a concentrate region, said diaphragm being movable, under fluid pressure exerted thereon, from a closed position in which it is in contact with said valve seat and closes said passageway, to an open position in which it is spaced from said seat and opens said passageway;

(e) means for maintaining said diaphragm in its closed position when the valve assembly is not being operated to dispense a beverage, comprising means for maintaining a fluid in said fluid pressure region under sufficient pressure to hold said diaphragm in its closed position against the pressure of any concentrate in said concentrate region;

(f) means for moving said diaphragm to its open position to operate said valve assembly to dispense a beverage therefrom, said moving means consisting of means for venting the pressure in said fluid pressure region and means for providing concentrate under pressure in said concentrate region;

(g) wherein said maintaining means and said venting means comprises a source of fluid under pressure, a fluid line connected from said source to said fluid pressure region, a three-way valve in said line and operable between a first condition establishing communication through said line, and a second condition closing said line to said source and venting to atmosphere said line to said fluid pressure region, and means for operating said three-way valve to change it from its first condition to its second condition;

(h) wherein said operating means for said three-way valve comprises a solenoid;

(i) wherein said fluid source is a pressurized air tank and said fluid line is an air line;

(j) including a pressure regulator in said air line located between said air tank and said three-way valve;

(k) including a pressurizable container for holding a quantity of concentrate, a concentrate air line connected between said container and said air line at a point therein between said regulator and said three-way valve, for pressurizing said container, and a concentrate conduit connected from said container to said concentrate passageway, whereby the same air pressure pressurizes said container and holds said diaphragm in its closed position;

(l) wherein said three-way valve is located adjacent to said valve assembly to minimize the length of said line therebetween;

(m) wherein said length is eight to ten inches;

(n) wherein said diaphragm includes a centrally located valve member portion thereof for sealing contacting said valve seat when said diaphragm is in its closed position;

(o) wherein said valve member portion is relatively thicker and stiffer than the remainder of said diaphragm and wherein said valve member portion is connected to one end of an elongated member mounted in said body for reciprocable movement such that said elongated member guides said valve member portion toward and away form said valve seat;

(p) wherein said body also includes a diluent passageway extending therethrough, a diluent valving chamber in said diluent passageway and having a diluent valve seat through which all diluent must flow, a diluent valve member movable onto and off of said diluent seat to close and open said diluent passageway, respectively, a solenoid means connected to said valve member for moving it between its open and closed positions, and including means for simultaneously energizing both said solenoid means and said three-way valve solenoid when said valve assembly is operated to dispense a beverage;

(q) including a compression spring located in said fluid pressure region for biasing said diaphragm toward its closed position;

(r) including a mixing and swirling chamber and a discharge nozzle, and wherein said nozzle includes an elongated, vertical, cylindrical passageway therethrough and a flat elongated plate centrally positioned therein to reduce swirling of the fluid flowing therethrough; and (s) wherein said mixing and swirling chamber includes a flat, transverse surface at the end of a larger diameter passageway, said transverse surface having a smaller diameter central opening therein, such that some of the fluid flowing through said larger diameter passageway hits said transfer surface and splashes back into said larger diameter passageway increases the mixture thereof.

2. A valve assembly for a beverage dispenser for dispensing a beverage mixed from a pressurized concentrate containing pulp and a pressurized diluent, comprising:

(a) a body including a concentrate passageway extending therethrough;

(b) a concentrate valving chamber in said body fluid communication with said passageway;

(c) a valve seat in said valving chamber through which valve seat all fluid in said passageway must flow;

(d) a flexible diaphragm extending across said chamber and sealing separating said chamber into a fluid pressure region and a concentrate region, said diaphragm being movable, under fluid pressure exerted thereon, from a closed postition in which it is in contact with said valve seat and closes said passageway, to an open position in which it is spaced from said seat and opens said passageway;

(e) means for maintaining said diaphragm in its closed position when the valve assembly is not being operated to dispense a beverage, comprising means for maintaining a fluid in said fluid pressure region under sufficient pressure to hold said diaphragm in its closed position against the pressure of any concentrate in said concentrate region;

(f) means for moving said diaphragm to its open position to operate said valve assembly to dispense a beverage therefrom, said moving means consisting of means for venting the pressure in said fluid pressure region and means for providing concentrate under pressure in said concentrate region;

(g) wherein said body also includes a diluent passageway extending therethrough, a diluent valving chamber in said diluent passageway, and valve means therein for controlling diluent flow therethrough, and including a mixing and swirling chamber and a discharge nozzle, and wherein said nozzle includes an elongated, vertical, cylindrical passageway therethrough and a flat elongated plate centrally positioned therein to reduce swirling of the fluid flowing therethrough; and (h) said mixing and swirling chamber includes a flat, transverse surface at the end of a larger diameter passageway, said transverse surface having a smaller diameter central opening therein, such that some of the fluid flowing through said larger diameter passageway hits said transfer surface and splashes back into said larger diameter passageway increases the mixing thereof.

3. A method for dispensing a beverage mixed from a concentrate containing pulp and a diluent, said method comprising:

(a) providing a valve assembly with a body including a concentrate passageway extending therethrough, a concentrate valving chamber in said passageway and having a valve seat through which all concentrate must flow, and a flexible diaphragm extending across said chamber and sealingly separating said chamber into a fluid pressure region and a concentrate region, said diaphragm being movable, under fluid pressure exerted thereon, from a closed position in which it is contact with said valve seat and closes said passageway to an open position in which it is spaced from said seat and opens said passageway;

(b) maintaining concentrate under pressure in said concentrate region;

(c) maintaining fluid in said fluid pressure region under sufficient pressure to hold said diaphragm in its closed position when said valve assembly is not being used to dispense a beverage;

(d) moving said diaphragm from its closed position to its open position when it is desired to operate said valve assembly to despense a beverage, said moving step consisting of venting to atmosphere the fluid in said fluid pressure region, whereby the pressure of the concentrate in said concentrate region pushes said diaphragm to its open position;

(e) wherein said maintaining step and said venting step comprise providing a three-way valve in an air line extending from an air tank to said fluid pressure region, the air line from said three-way valve to said fluid pressure region having a length of 8 to 10 inches, said three-way valve having a first condition in which it establishes fluid communication through said air line, and having a second condition closing said air line to said air tank and venting to atmosphere said fluid pressure region, and including the step of maintaining said three-way valve in said first condition when said valve assembly is not being used to dispense a beverage and operating said three-way valve to change it from its first condition to its second condition when it is desired to operate said valve assembly to dispense a beverage;

(f) wherein said three-way valve is solenoid controlled and said three-way valve operating step comprises energizing said solenoid;

(g) wherein said body also includes a diluent passageway extending therethrough, a diluent valving chamber in said diluent passageway and having a diluent valve seat through which all diluent must flow, a diluent valve member movable onto and off of said diluent valve seat to close and open said diluent passageway, respectively, a solenoid connected to said valve member for moving it between its open and closed positions, and including the step of energizing said diluent valve member solenoid simultaneously with the step of energizing said three-way valve solenoid;

(h) wherein said diaphragm includes a centrally located valve member portion thereof for sealingly contacting said valve seat when said diaphragm is in its closed position and including the step of connecting said valve member portion to an end of an elongated member mounted in said body for reciprocal movement to guide said valve member portion onto and away from said valve seat as said diaphragm moves from its closed to its open position;

(i) including the step of mixing and swirling a mixture of concentrate and diluent downstream from said concentrate valving chamber and said diluent valving chamber and then feeding said mixing and swirling fluid into a nozzle having an elongated vertical cylindrical passageway therethrough and providing a flat elongated plate centrally positioned therein to reduce swirling of the fluid as it discharges from said nozzle; and (j) wherein said mixing step includes feeding a mixture of diluent and concentrate through a larger diameter passageway and against a flat transverse surface having a smaller diameter central opening therein such that some of the fluid flowing through said larger diameter passageway hits said transverse surface and splashes back into said larger diameter passageway increasing the mixing thereof.

4. A method for dispensing a beverage mixed from a concentrate containing pulp and a diluent, said method comprising:

(a) providing a valve assembly with a body including a concentrate passageway extending therethrough, a concentrate valving chamber is said passageway and having a valve seat through which all concentrate must flow, and a flexible diaphragm extending across said chamber and sealingly separating said chamber into a fluid pressure region and a concentrate region, said diaphragm being movable, under fluid pressure exerted thereon, from a closed position in which it is in contact with said valve seat and closes said passageway to an open position in which it is spaced from said seat and opens said passageway;

(b) maintaining concentrate under pressure in said concentrate region;

(c) maintaining fluid in said fluid pressure region under sufficient pressure to hold said diaphragm in its closed position when said valve assembly is not being used to dispense a beverage;

(d) moving said diaphragm from its closed position to its open position when it is desired to operate said valve assembly to dispense a beverage, said moving step consisting of venting to atmosphere the fluid in said fluid pressure region, whereby the pressure of the concentrate in said concentrate region pushes said diaphragm to its open position;

(e) including the step of mixing and swirling a mixture of concentrate and diluent downstream from said concentrate valving chamber and said diluent valving chamber and then feeding said mixing and swirling fluid into a nozzle having an elongated vertical cylindrical passageway therethrough and providing a flat elongated plate centrally positioned therein to reduce swirling of the fluid as it discharges from said nozzle; and (f) said mixing step includes feeding a mixture of diluent and concentrate through a larger diameter passageway and against a flat transverse surface having a smaller diameter central opening therein such that some of the fluid flowing through said larger diameter passageway hits said transverse surface and splashes back into said larger diameter passageway increasing the mixing thereof.

* * * * *